US007960317B2

(12) United States Patent
Ziegert et al.

(10) Patent No.: US 7,960,317 B2
(45) Date of Patent: Jun. 14, 2011

(54) IN-SITU LUBRICATION OF SLIDING ELECTRICAL CONTACTS

(75) Inventors: John C. Ziegert, Seneca, SC (US); Wallace G. Sawyer, Gainesville, FL (US); David L. Burris, Gainesville, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 558 days.

(21) Appl. No.: 11/908,088

(22) PCT Filed: Mar. 8, 2006

(86) PCT No.: PCT/US2006/008152

§ 371 (c)(1), (2), (4) Date: May 2, 2008

(87) PCT Pub. No.: WO2006/096742

PCT Pub. Date: Sep. 14, 2006

(65) Prior Publication Data

US 2008/0272670 A1 Nov. 6, 2008

Related U.S. Application Data

(60) Provisional application No. 60/659,719, filed on Mar. 8, 2005.

(51) Int. Cl.
*H01R 39/56* (2006.01)
*C10M 103/04* (2006.01)

(52) U.S. Cl. ..... 508/110; 508/113; 508/123; 508/150; 310/228

(58) Field of Classification Search ..... 508/150, 508/110; 310/228
See application file for complete search history.

(56) References Cited

U.S. PATENT DOCUMENTS

| | | | | |
|---|---|---|---|---|
| 2,414,543 | A | 1/1947 | Moberly | |
| 3,290,472 | A | 12/1966 | Savage | |
| 3,437,592 | A | 4/1969 | Boes et al. | |
| 4,277,708 | A * | 7/1981 | McNab et al. | 310/228 |
| 6,666,671 | B1 * | 12/2003 | Olver et al. | 418/173 |

FOREIGN PATENT DOCUMENTS

| | | |
|---|---|---|
| DE | 2845327 | 4/1980 |
| DE | 2845327 A1 | 4/1980 |

(Continued)

OTHER PUBLICATIONS

Sharke, The Hunt for Compact Power, Geophysics, Society of Exploration Geophysicists, Tulsa, OK, USA (Apr. 2000).

(Continued)

*Primary Examiner* — Ellen M McAvoy
*Assistant Examiner* — Taiwo Oladapo
(74) *Attorney, Agent, or Firm* — Thomas, Kayden, Horstemeyer & Risley, LLP

(57) ABSTRACT

A method for in-situ solid lubrication of sliding electrical contacts includes the steps of providing a device having a movable electrically conductive first member and an electrically conductive second member, the first and second member being in electrical contact at a slideable electrical contact, and automatically applying an electrically conductive solid lubricant transfer film to the slideable electrical contact during operation of the device. The applying step can be a deposition of the electrically conductive solid lubricant transfer film on a surface of the first member, wherein the electrically conductive solid lubricant transfer film is carried by movement of the first member to the electrical contact.

20 Claims, 3 Drawing Sheets

FOREIGN PATENT DOCUMENTS

| | | | | |
|---|---|---|---|---|
| FR | 1057580 | | | 3/1954 |
| FR | 1057580 | A | | 3/1954 |
| GB | 807799 | | | 1/1959 |
| GB | 807799 | A | | 1/1959 |
| JP | 2000282259 | A | * | 10/2000 |
| JP | 2000 282259 | | | 2/2001 |
| JP | 2000282259 | A | | 2/2001 |

OTHER PUBLICATIONS

International Search Report and Written Opinion dated Jul. 24, 2006.

Sharke, "The Hunt for Compact Power" Geophysics, Society of Exploration Geophysicists, Tulsa, OK, Apr. 2000.

* cited by examiner

IN-SITU LUBRICATION OF SLIDING ELECTRICAL CONTACTS

CROSS-REFERENCE TO RELATED APPLICATIONS

This application is a §371 national stage entry of International Application No. PCT/US2006/008152, filed Mar. 8, 2006, which claims priority to U.S. Provisional Application No. 60/659,719, filed Mar. 8, 2005, both of which are hereby incorporated by reference.

FIELD OF THE INVENTION

The invention relates to electrically conductive solid lubricant comprising transfer films including a solid lubricant, and at least one soft metal, and methods for applying the same during operation of systems having sliding electrical contacts.

BACKGROUND OF THE INVENTION

One of the primary goals of lubricants is obtaining low friction. Solid lubrication offers many benefits over conventional oil-based hydrodynamic and boundary lubrication. Solid lubrication systems are generally more compact and less costly than oil lubricated systems since pumps, lines, filters and reservoirs are usually required in oil lubricated systems. Greases can contaminate the product of the system being lubricated, making it undesirable for food processing, and grease and oil outgas in a vacuum preclude their use in space applications.

In some lubrication applications, sliding electrical contacts connect two electrically conductive members which transmit high current density from one conductive member to the other conductive member across the sliding contact. In such applications, the lubricant material typically must be highly electrically conductive. These applications include a wide variety of military hardware, including slip-rings in tilt wing aircraft, antennae, radar pointing systems, and electrical motors. Conventional solid lubricants currently available generally provide insufficient wear protection for some important applications. For example, even with the use of available solid lubricants to reduce wear rates and friction, current efforts to develop a Superconducting Homopolar Motor (SCHPM) for ship propulsion have been hampered by excessive wear in the brush system which conducts high electrical currents from the rotor to the stator.

Since the brushes of SCHPMs are known to wear during use, designers typically must base design decisions on an assumed wear rate for the brushes based on past experience and projected technology development, which generally results in a minimum required wear length for the brushes. Wear rate is a strong function of contact force. In order to be able to achieve the required wear rates, contact forces need to be kept very low, on the order of about 3 to 4 N. Unfortunately, for electrical contacts between bulk solids, low contact forces can result in high contact resistance as well as excessive heating and losses at the interface. The difficulty is sometimes addressed by the use of multifilament wire brushes, in an attempt to achieve satisfactory contact resistance at these low forces. However, when multifilament brushes are used in the high magnetic fields and high current densities of the SCHPM, electromagnetic forces on the individual filaments of the brush are typically high enough to distort the filaments, often quite significantly, thus changing the true contact force and altering the brush wear rate in some sections of the motor.

SUMMARY OF THE INVENTION

One embodiment of the invention is a method for in-situ solid lubrication of sliding electrical contacts. The method can include providing a device comprising a movable electrically conductive first member and an electrically conductive second member. The first and second members, according to the method, are in electrical contact at a slideable electrical contact. The method can further include automatically applying to the slideable electrical contact during operation of the device a film of electrically conductive solid lubricant, the applied film being defined herein as an electrically conductive solid lubricant transfer film.

Another embodiment of the invention is a system having in-situ solid lubrication of sliding electrical contacts. The system can include a device comprising a movable electrically conductive first member and an electrically conductive second member. The first and second member of the device can be in electrical contact at a slideable electrical contact. The system further can include a source of electrically conductive solid lubricant transfer film. The electrically conductive solid lubricant transfer film can be automatically applied to the slideable electrical contact during operation of the device.

Yet another embodiment of the invention is an electrically conductive solid lubricant transfer film. The film can comprise a solid lubricant and at least one soft metal intermixed with the solid lubricant. The bulk resistivity of the lubricant film is preferably no more than 4 times the bulk resistivity of copper (Cu) at 25 C.

BRIEF DESCRIPTION OF THE DRAWINGS

A fuller understanding of the present invention and the features and benefits thereof will be accomplished upon review of the following detailed description together with the accompanying drawings, in which.

DETAILED DESCRIPTION

A method for in-situ solid lubrication of sliding electrical contacts, according to one embodiment of the invention, includes the steps of providing a device comprising a movable electrically conductive first member and an electrically conductive second member. The first and second member are in electrical contact at a slideable electrical contact. A sacrificial electrically conductive solid lubricant transfer film is automatically applied to the slideable contact during operation of the device. In one embodiment, the solid lubricant is applied to a surface of the first member during operation of the device. In this embodiment, the electrically conductive solid lubricant transfer film is carried by movement of the first member to the electrical contact to reduce the wear rate of the first and/or second member.

The presence of the electrically conductive solid lubricant transfer film at the slideable contact effectively eliminates wear by eliminating the need for intimate contact between the surfaces of the first and second member. Because the solid lubricant is very soft and highly electrically conductive, large current densities can be passed through the electrically conductive solid lubricant transfer film without direct metal to metal contact.

In a typical but non-limiting example, the second member is a brush, such as a copper brush. Using the invention, the brush wear rate is reduced to a low level through the use of a periodically replenished, electrically conductive, solid lubricant. In one of many possible applications of the invention, the invention is applied to a Superconducting Homopolar Motor (SCHPM), as used in a propulsion system for providing propulsion to an ocean-going naval ship or other waterborne vessel. As applied to an SCHPM, the invention may provide a dramatic simplification in the brush/holder system design, a significant increase in the reliability of such a system. Such an application of the invention may remove what is considered by many to be the most significant remaining technological barrier to the adoption of SCHPMs in naval propulsion systems. Application of the invention to SCHPMs for ship propulsion systems also would likely improve national and homeland security by improving combat readiness of U.S. Navy and other military defense ships by substantially reducing the downtime of such ships.

Figure 1:
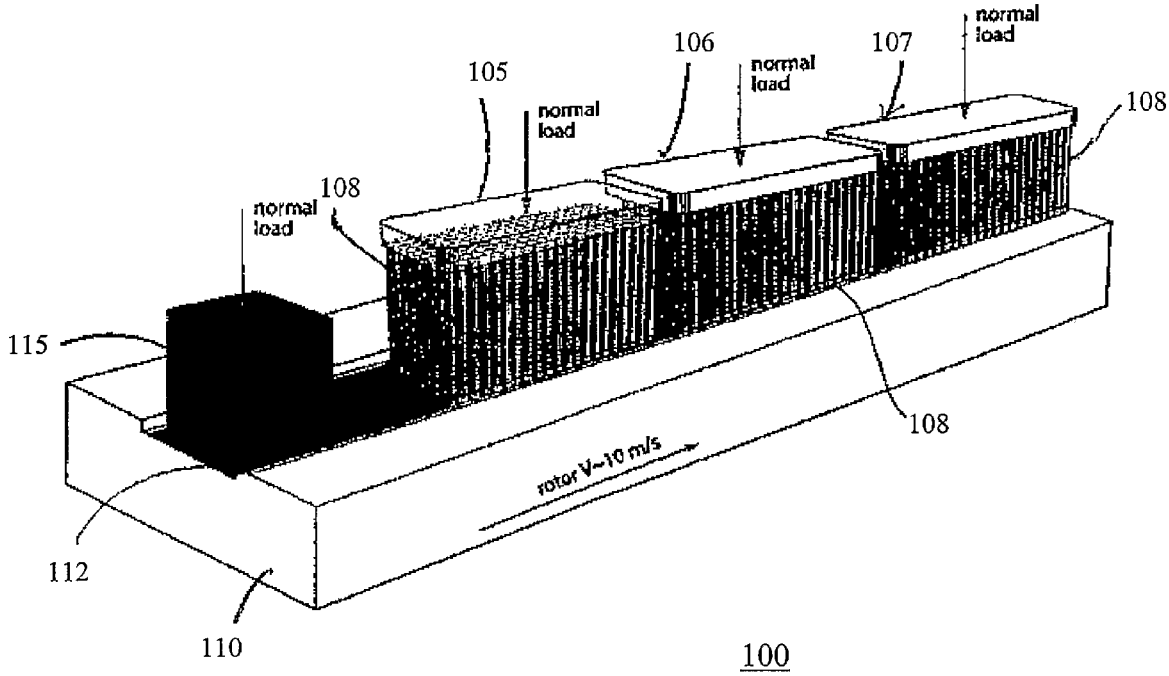
FIG. 1 is a perspective view of an in situ conductive solid lubrication system in which an electrically conductive transfer film is deposited on the rotor during system operation for reducing wear between the copper brushes and the rotor, according to an embodiment of the invention.

FIG. 1 is a prespective representation of an situ solid lubrication system 100, according to one embodiment of the invention. Copper brushes 105, 106,107 having a plurality of filaments 108 illustratively provide electrical contact to a copper rotor 110. As illustrated in FIG. 1, in a particular application, the rotor 110 can rotate at a moving rate of about 10 m/sec. In the in situ approach, according to this embodiment of the invention, a sacrificial protective solid lubricant film 112 is deposited on the surface of the rotor 110 during system operation. A solid block 115 of electrically conductive solid lubricant transfer film is pressed against the rotor 110 using a normal force to supply transfer film which is brought to the sliding contact by the movement of rotor 110. The presence of the transfer film 112 under the copper brushes 105, 106, 107 effectively eliminates wear, or substantially reduces wear by allowing copper brushes 105, 106, 107 and copper rotor 110 to be physically separated during system operation, the electrically conductive solid lubricant transfer film being between the brushes and rotor. Although continuous deposition is shown in FIG. 1, in a preferred embodiment, intermittent application of the transfer film is used, such as a periodic application of transfer film for one minute or less for every one hour of protection during operation.

Although a frictional source is shown in FIG. 1, a variety of other deposition sources can be used to deposit the solid lubricant film 112. The various deposition sources can include, for example, pulse laser sources as well as a variety of known powder-delivery sources.

Although not explicitly shown in FIG. 1, rather than apply solid lubricant transfer films at predetermined periods, systems according to the invention can additionally include a sensor and related feedback-and-control system for determining when to initiate application of the transfer film as well as when to terminate application of the transfer film once initiated. Sensors can include force sensors (e.g. friction), temperature sensors, acoustic sensors, and/or surface chemistry based sensors. Based on sensor measurements, such as when the friction coefficient at the contact exceeds a predetermined value, deposition can be initiated to provide an electrically conductive solid lubricant transfer film, or coating, to the slideable electrical contact.

As noted above, the system shown in FIG. 1 applies a normal load to solid lubricant block 115 to initiate the transfer film deposition which travels laterally to reach the slideable contact. Applied to such a system, once the friction coefficient falls to below a predetermined friction coefficient, the deposition can be terminated, such as by removing the normal force applied to end the transfer film deposition.

Friction between the block of the electrically conductive solid lubricant transfer film 115 and the rotor 110 shown in FIG. 1 caused by application of the normal load shown generates the typically submicron thick transfer film which comprises a plurality of particles. Because the solid lubricant can be engineered to be both very soft and electrically conductive, large current densities can be passed through the thin, generally sub-micron thick transfer film without direct copper-to-copper contact. A typical thickness of the transfer film 112 is about 0.2 to 0.8 μm, such as 0.5 μm.

Regarding the solid lubricant, generally preferred choices are graphite, molybdenum disulfide ($MoS_2$), and tungsten disulfide ($WS_2$). In a dry form, a powder of these materials are effective lubricant additives due to their lamellar structure. The lamellas tend to orient parallel to the surface in the direction of motion.

Even between highly loaded stationary surfaces the lamellar structure is able to prevent contact. In the direction of motion the lamellas easily shear over each other resulting in low friction. Large particles generally best perform on relatively rough surfaces at low speed, while finer particles generally perform best on relative smooth surfaces at higher speeds. Other solid lubricants that may be used include, but are not limited to, boron nitride, polytetrafluorethylene (PTFE), talc, calcium fluoride, and cerium fluoride.

The electrically conductive solid lubricant transfer film 112, moreover, can include at least one soft metal. The soft metals can include gallium, indium, thallium, lead, tin, gold silver, copper and the Group VII noble metals, and mixtures thereof.

In one exemplary embodiment, the lubricant film comprises graphite, silver, and indium. In this embodiment, the lubricant can comprise 30 to 70 wt % graphite, 15 to 35 wt % silver, and the remainder indium, such as 50 wt % graphite/25 wt % silver, and the remainder indium. In one test, using a system arrangement analogous to that shown in FIG. 1, the graphite/silver/indium film was found to lay down a uniform 0.5 micrometer thick transfer film on the copper rotor surface. Using four point probe measurements of the transfer film at room temperature, the bulk resistivity of the film was found to be about twice the bulk resistivity of pure copper.

Although not necessary for practicing the invention, the inventors, though not seeking to be bound, propose the following mechanism for solid lubricants according to one embodiment of the invention. The film generation appears to be well behaved and the thickness of the film generated is essentially linearly proportional to the applied contact pressure (normal load). The removal mechanisms of the transfer film from the sliding interface is more complex. Regarding application to the brush/rotor system illustrated in FIG. 1, the lubricant film has at least three pathways of consumption and flow: (1) consumption into the pores of the copper brushes 105-107, (2) side-flow out of the sliding contact, and (3) flow through and under the copper brushes 105-107. Performance is improved by minimizing the consumption and side-flow mechanisms, which maximizes the flow under the copper brushes.

Figure 2:
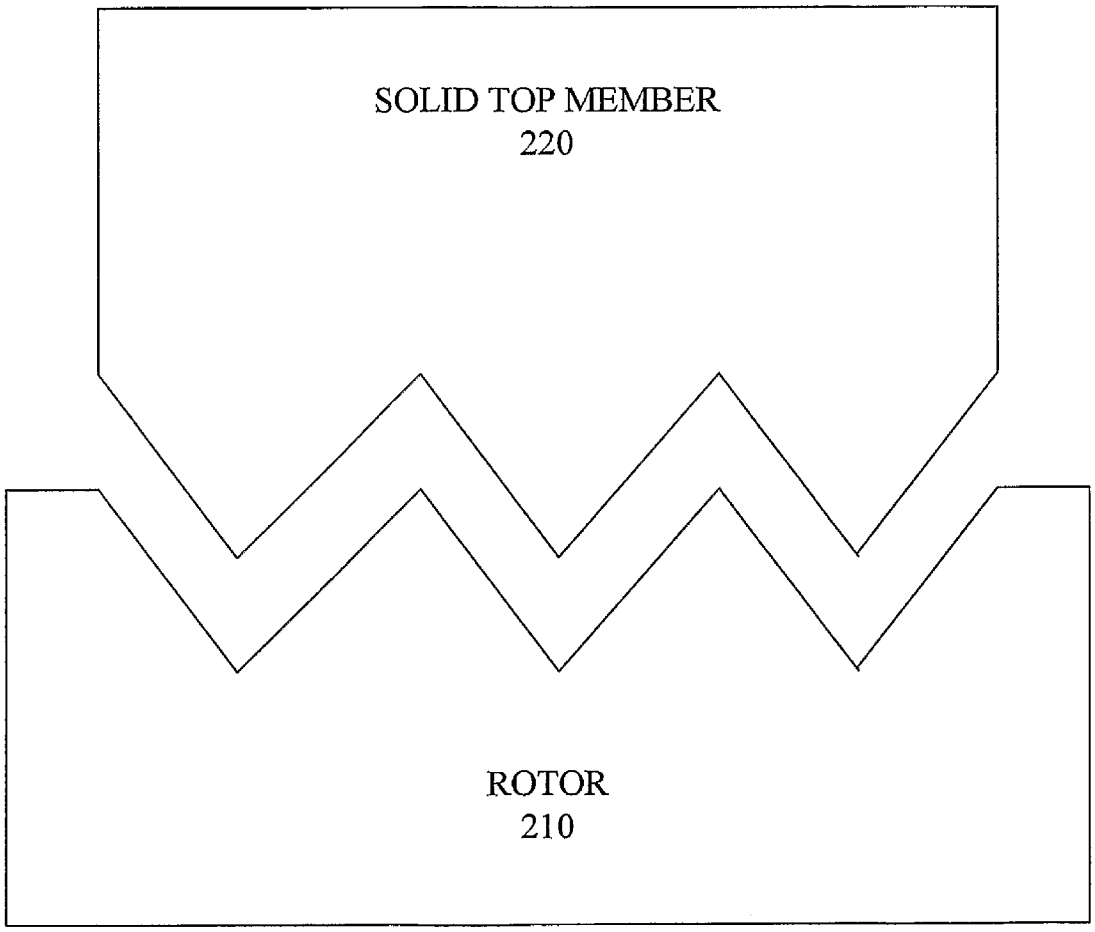
FIG. 2 is a schematic representation of an exemplary film retention-promoting geometry for an exemplary rotor-stator configuration having first and second members that each include triangular teeth which fit together, according to another embodiment of the invention.

In one embodiment of the invention, the movable electrically conductive first member and an electrically conductive second member are formed in a film retention-promoting geometry that tends to maximize the flow of the solid lubricant into the slideable electrical contact as well as the retention at the slideable contact. For example, FIG. 2 shows an exemplary film retention-promoting geometry, where the first member 210, such as a rotor, and second member 220 each include triangular teeth that fit together. The second member 220 is shown as a solid member including teeth, rather than being a conventional, multi-filament brush. One of ordinary skill in the art will appreciate that a variety of other geometries based on the invention can be used to help promote retention of solid lubricant at the contact as compared to a planar rotor surface.

EXAMPLE

The present invention is further illustrated by the following example. The example, however, is only for the purpose of illustrating aspects of the invention and should not be construed as limiting the scope or content of the invention in any way.

Figure 3A:
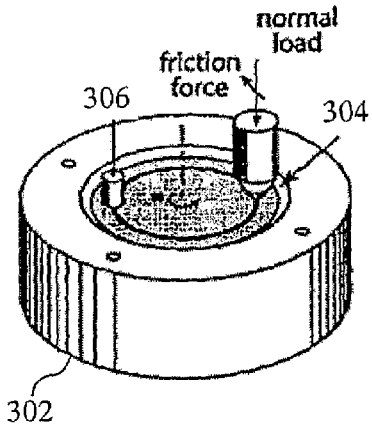
FIG. 3A is a perspective view of a high-speed rotating pin-on-disk tribometer for testing the effects of providing in situ solid lubrication according to the invention.
Figure 3B:
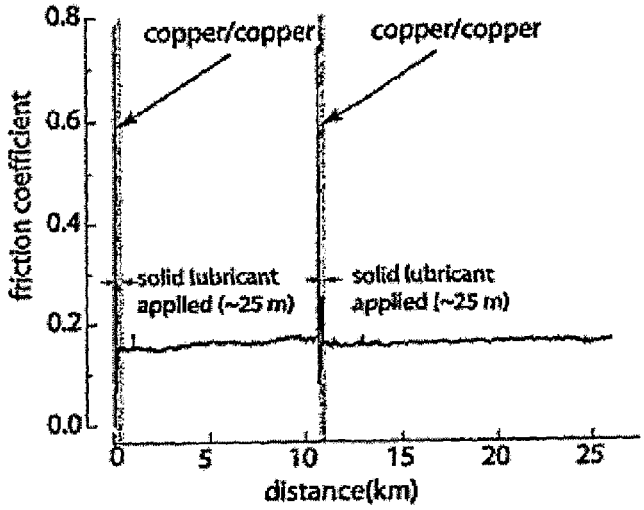
FIG. 3B is a graphical presentation of selected measurements obtained from testing the effects of using in situ solid lubrication on the device of FIG. 3A.

Referring to FIGS. 3A and 3B, a demonstration of the in situ solid lubrication of self-mated copper contacts was performed on a high-speed rotating pin-on-disk tribometer. The experimental setup is illustrated in FIG. 3A. Corresponding results are presented graphically in FIG. 3B. The copper disk 302 shown was sanded to an initial surface roughness of Ra~0.15 μm and had a diameter of approximately 50 mm. The copper pin 304 had a diameter of approximately 6 mm and was loaded against the copper disk 302 by a dead weight load of 5N. The disk 302 was rotated at a constant angular speed resulting in a sliding speed at the contact of 1.5 m/s. The solid lubricant pin 306 was unloaded and could be manually brought into contact as needed.

As illustrated by the graph in FIG. 3B, at the beginning of the test, with no solid lubricant present, the friction coefficient rapidly rose to $\mu=0.8$, which is typical for self-mated copper contacts. The surfaces wore rapidly, with rates exceeding $K=1\times10^{-3}$ $mm^3/(Nm)$. Additionally, the initially smooth surface topography was lost resulting in very high surface roughness. The solid lubricant pin 306 was then pressed against the wear track and held for approximately 25 m of sliding distance. Over this period the surfaces were healed, and the friction coefficient rapidly dropped to below $\mu=0.1$. After unloading the solid lubricant pin 306 the friction coefficient rose to $\mu=0.15$ and remained steady for over 10 km of sliding at which time there was a sudden failure of the tribo-film and the friction coefficient rapidly rose to a value consistent with self-mated copper contacts. At this point, the solid lubricant film was again applied and the process of healing the damaged surfaces and offering prolonged protection of the copper contacts was demonstrated.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A method for in-situ solid lubrication of sliding electrical contacts, comprising the steps of:

providing a device comprising a movable electrically conductive first member and an electrically conductive second member, said first and second members being in electrical contact at a slideable electrical contact, and automatically applying an electrically conductive solid lubricant transfer film to said slideable electrical contact during operation of said device.

2. The method of claim 1, wherein said applying step comprises depositing said electrically conductive solid lubricant transfer film on a surface of said first member, wherein said electrically conductive solid lubricant transfer film is carried by movement of said first member to said electrical contact.

3. The method of claim 2, wherein said depositing step comprises forcing a source of said electrically conductive solid lubricant transfer film against said first member.

4. The method of claim 1, wherein said first member comprises a rotor.

5. The method of claim 1, wherein said second member comprises a contact brush, said contact brush electrically coupled to a stator.

6. The method of claim 1, wherein said electrically conductive solid lubricant transfer film comprises graphite and at least one soft metal.

7. The method of claim 6, wherein said soft metal comprises silver and indium.

8. The method of claim 1, wherein a bulk resistivity at 25 C of said electrically conductive solid lubricant transfer film is less than 4 times a bulk resistivity of copper.

9. The method of claim 1, wherein said applying step comprises a plurality of application intervals separated by a plurality of intervals where no electrically conductive solid lubricant transfer film is applied to said slideable electrical contact.

10. The method of claim 9, further comprising the steps of sensing at least one parameter relating to friction at said slideable electrical contact, and determining said application intervals based on said parameter.

11. A system having in-situ solid lubrication of sliding electrical contacts, comprising:

a device comprising a movable electrically conductive first member and an electrically conductive second member, said first and second member being in electrical contact at a slideable electrical contact, and a source of electrically conductive solid lubricant transfer film, wherein said electrically conductive solid lubricant transfer film is automatically applied to said slideable electrical contact during operation of said device.

12. The system of claim 11, further comprising at least one sensor for measuring at least one parameter relating to friction at said slideable electrical contact, and a controller for determining application intervals of said solid lubricant film based on said parameter.

13. The system of claim 12, wherein the at least one sensor is a sensor comprises at least one of a force sensor, a temperature sensor, an acoustic sensor, and a surface chemistry -based sensor.

14. The system of claim 11, wherein said solid lubricant film is carried by movement of said first member to said slideable electrical contact.

15. The system of claim 11, wherein said first and second member have a film retention-promoting geometry, wherein said geometry reduces outflow of said solid lubricant as compared to a substantially planar first member.

16. The system of claim 11, wherein the source comprises at least one of a pulse laser source and a power-delivery source.

17. The system of claim 11, wherein the device and source are components of a Superconducting Homopolar Motor (SCHPM).

18. The system of claim 11, wherein the SCHPM is configured to provide propulsion to a sea-borne vessel.

19. The system of claim 11, wherein the electrically conductive solid lubricant transfer film includes a solid lubricant and at least one soft metal intermixed with said solid lubricant, wherein an bulk resistivity of said lubricant film is no more than 4 times a bulk resistivity of Cu at 25 C.

20. The system of claim 19, wherein the soft metal comprises silver and indium.

* * * * *